US006478636B1

(12) United States Patent
Makita et al.

(10) Patent No.: US 6,478,636 B1
(45) Date of Patent: Nov. 12, 2002

(54) FEMALE TERMINAL FITTING

(75) Inventors: Yasumitsu Makita, Yokkaichi (JP); Kiyofumi Ichida, Yokkaichi (JP); Hideshi Tachi, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/678,306

(22) Filed: Oct. 3, 2000

(30) Foreign Application Priority Data

Oct. 8, 1999 (JP) ..... 11-288624

(51) Int. Cl.[7] ..... H01R 11/22
(52) U.S. Cl. ..... 439/852
(58) Field of Search ..... 439/852, 862, 439/845, 849, 850

(56) References Cited

U.S. PATENT DOCUMENTS 5,443,592 A * 8/1995 Ittah et al. ..... 439/852
5,575,696 A * 11/1996 Endo et al. ..... 439/852
5,630,738 A * 5/1997 Ito et al. ..... 439/852
5,707,259 A 1/1998 Ishizuka et al. ..... 439/852
5,733,155 A * 3/1998 Sagawa ..... 439/852
5,791,945 A * 8/1998 Myer et al. ..... 439/852
6,116,970 A * 9/2000 Yamamoto et al. ..... 439/852

* cited by examiner

*Primary Examiner*—Hien Vu
*Assistant Examiner*—Felix O. Figueroa
(74) *Attorney, Agent, or Firm*—Banner & Witcoff, Ltd.

(57) ABSTRACT

A female terminal fitting has a wall member which is not weakened as a result of cutting away bending regulating members therefrom, these bending regulating members preventing the excessive bending of a resilient contacting member. Anterior and posterior bending regulating members 26F and 26R are formed by cutting away a portion of a fitting member 11. These bending regulating members 26F and 26R prevent a resilient contacting member 20 firm bending excessively. The anterior bending regulating members 26R are formed on a base wall 13, and the posterior bending regulating members 26F are formed on side walls 14. These bending regulating members 26F and 26R are formed on differing walls. Consequently, compared to the case where both bending regulating members 26F and 26R are formed on a single wall, the opening area formed by cutting away the bending regulating members is smaller on each wall, and accordingly the strength of the walls is maintained.

17 Claims, 6 Drawing Sheets

FEMALE TERMINAL FITTING

TECHNICAL FIELD

The present invention relates to female electrical terminal fitting.

BACKGROUND TO THE INVENTION

A female terminal fitting is provided with an angular tubular-shaped fitting member into which a tab of a corresponding male terminal fitting can be inserted, and with a resilient contacting member which protrudes into the fitting member in a bent-over shape from an anterior end of a base wall of this fitting member, this resilient contacting member making resilient contact with the male tab. Different female terminal fittings are provided with differing means to prevent the resilient contacting member from bending excessively. An example of one of these means is described in JP-9-35796.

As shown in FIG. 8 of this specification, a female terminal fitting is provided with: an angular tubular-shaped fitting member 101 into which a tab (not shown) of a male terminal fitting can be inserted: a resilient contacting member 102 which extends within the fitting member 101 in the direction of insertion of the tab (the left-right direction in FIG. 8) and which is capable of bending resiliently as the tab is inserted into the fitting member 101, thereby making contact with the tab; and two bending regulating members 104 and 105, these bending regulating members 104 and 105 being formed by cutting away a base wall 103 of the fitting member 101. When the resilient contacting member 102 is at the point of bending excessively, a lower face of this resilient contacting member 102 makes contact with one or both of the two bending regulating members 104 and 105, thereby preventing the resilient contacting member 102 from bending excessively.

In the conventional female terminal fitting, both of the bending regulating members 104 and 105 are formed on the base wall 103. Consequently, the area of an opening 106 formed by the cutting away of the bending regulating members 104 and 105 is large, and the base wall 103 is weakened.

The present invention has taken the above problem into account, and aims to present a female terminal fitting wherein the wall member of the fitting member is not weakened as a result of cutting away bending regulating members therefrom, these bending regulating members preventing the excessive bending of the resilient contacting member.

SUMMARY OF THE INVENTION

According to the invention, there is provided a female terminal fitting comprising an elongate box-like body of sheet metal and having an open end adapted to receive a tab of a male terminal fitting in a fitting direction, the body having a resilient contacting member extending in the fitting direction, and in use bending resiliently on contact with a male tab, the female fitting further comprising bending regulating members part sheared from said body and underlying said contacting member to prevent excessive bending thereof, characterized in that said bending regulating members are formed from two or more different walls of said body. Such an arrangement reduces the weakening of the body as a result of forming all bending regulating members in the same side wall.

In the preferred embodiment the contacting member has a pent shape with a contact defined at the apex for making electrical contact with a male terminal tab. Two regulating members preferably project towards each other from opposite side walls and present aligned planar faces for contact with the underside of said contacting member. The apertures corresponding to these regulating members are preferably arranged to permit viewing of the contacting member therethrough.

A regulating member preferably protrudes towards the underside of the contacting member at right angles, and a window is preferably formed in a side wall of the body through which this regulating member may be inspected.

In a preferred embodiment, the mouth of the body has inturned portions which narrow the mouth and regulate the width thereof for receiving a male tab.

DESCRIPTION OF PREFERRED EMBODIMENT

Figure 1:
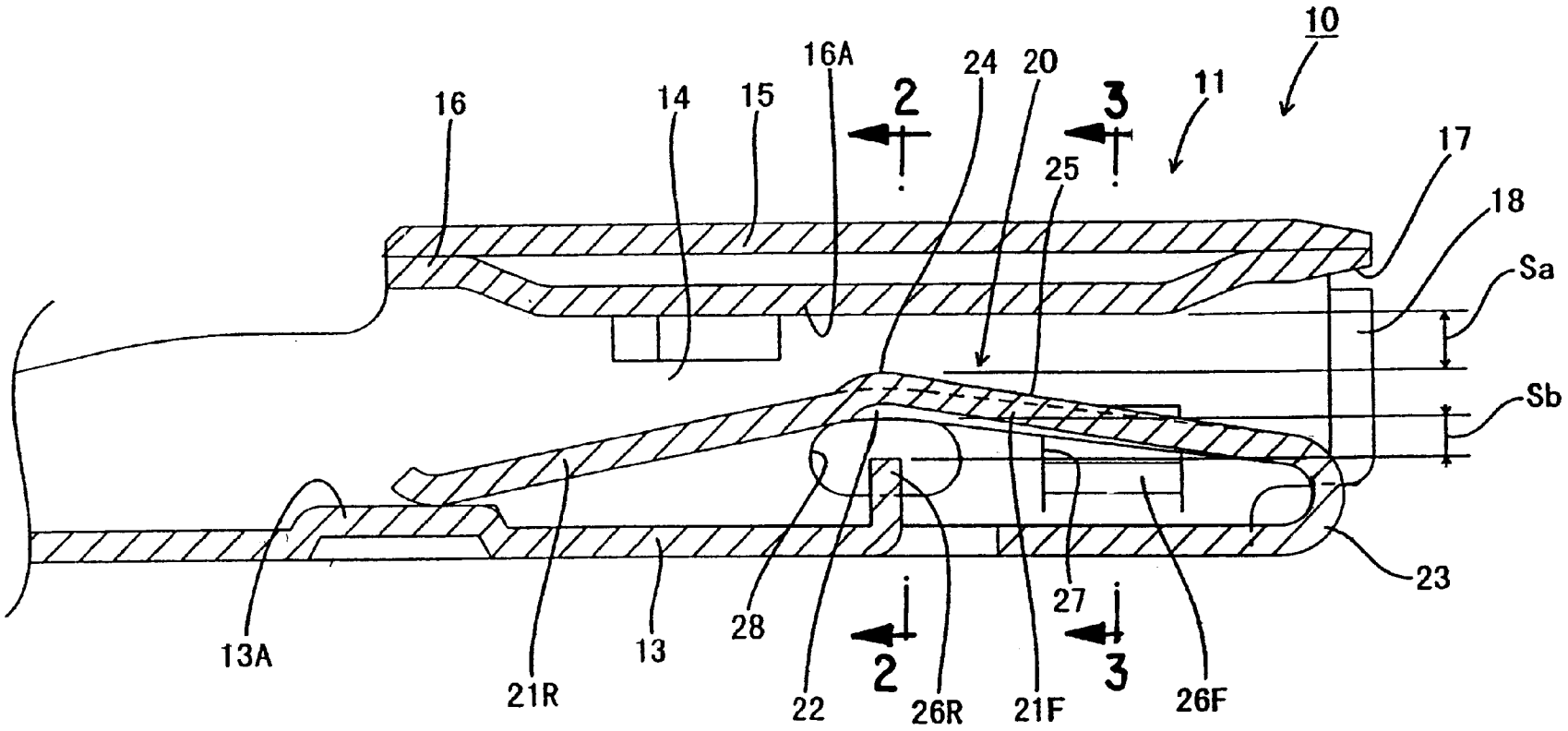
FIG. 1 is a cross-sectional view of embodiment 1.
Figure 3:
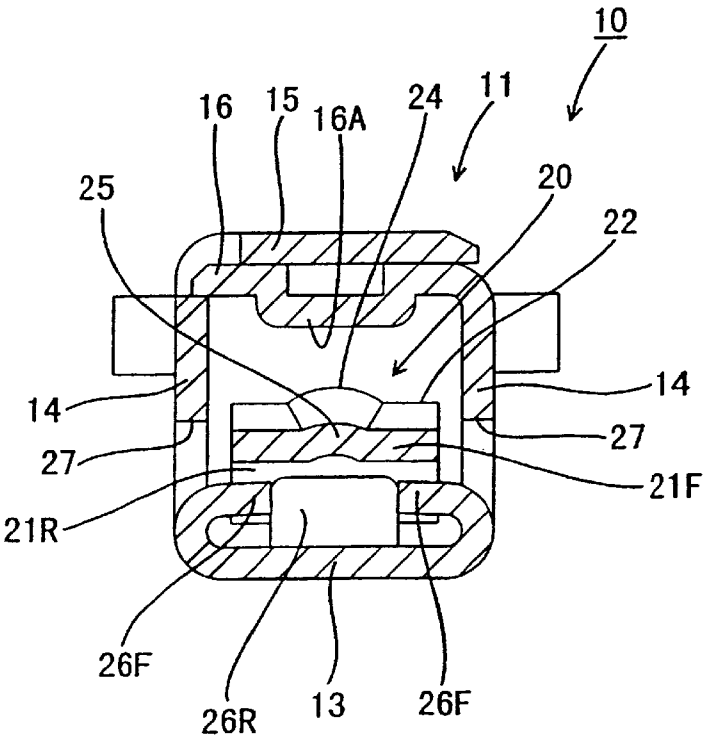
FIG. 3 is a side cross-sectional view of FIG. 1 along the line 3—3.
Figure 2:
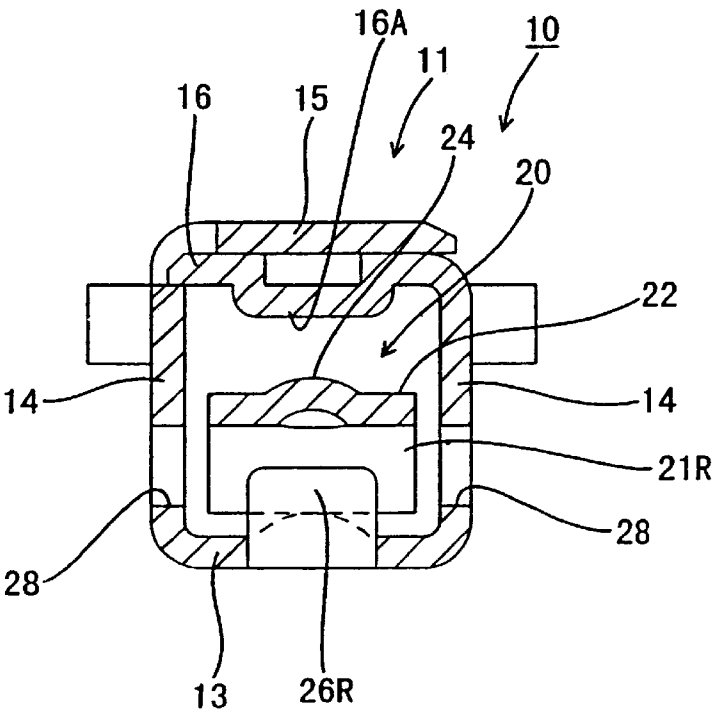
FIG. 2 is a side cross-sectional view of FIG. 1 along the line 2—2.
Figure 4:
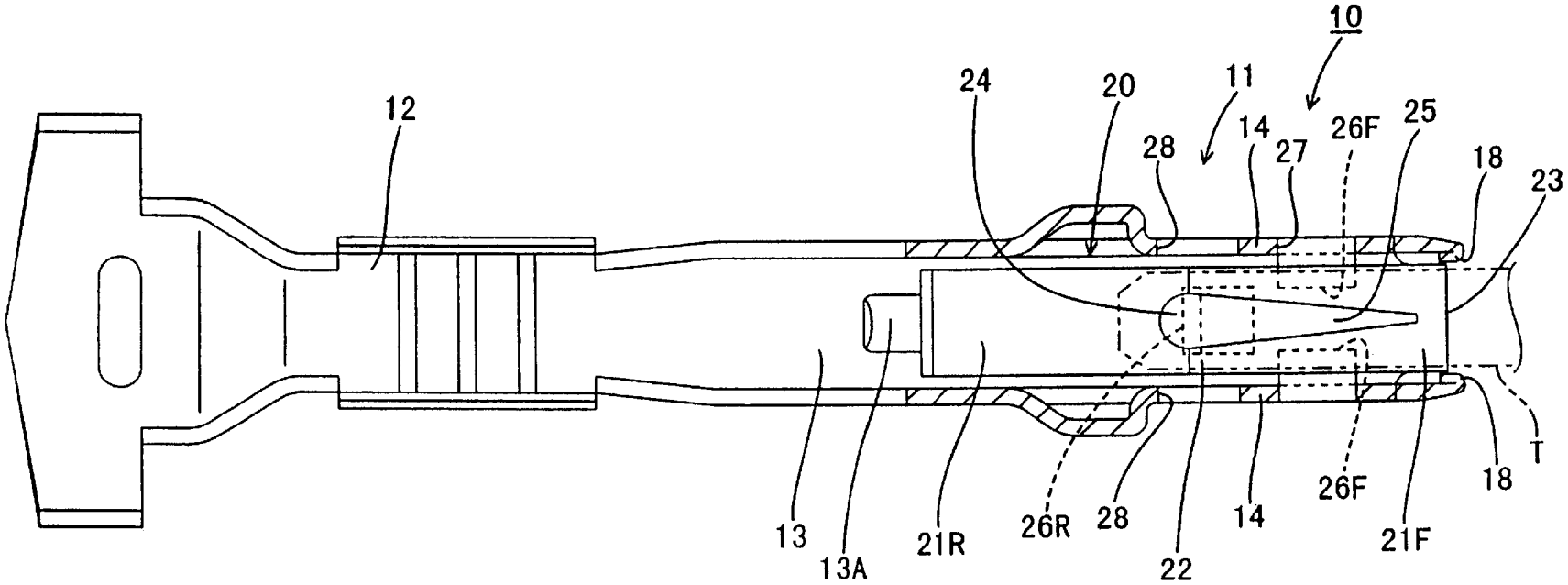
FIG. 4 is a top longitudinal cross-sectional view.
Figure 5:
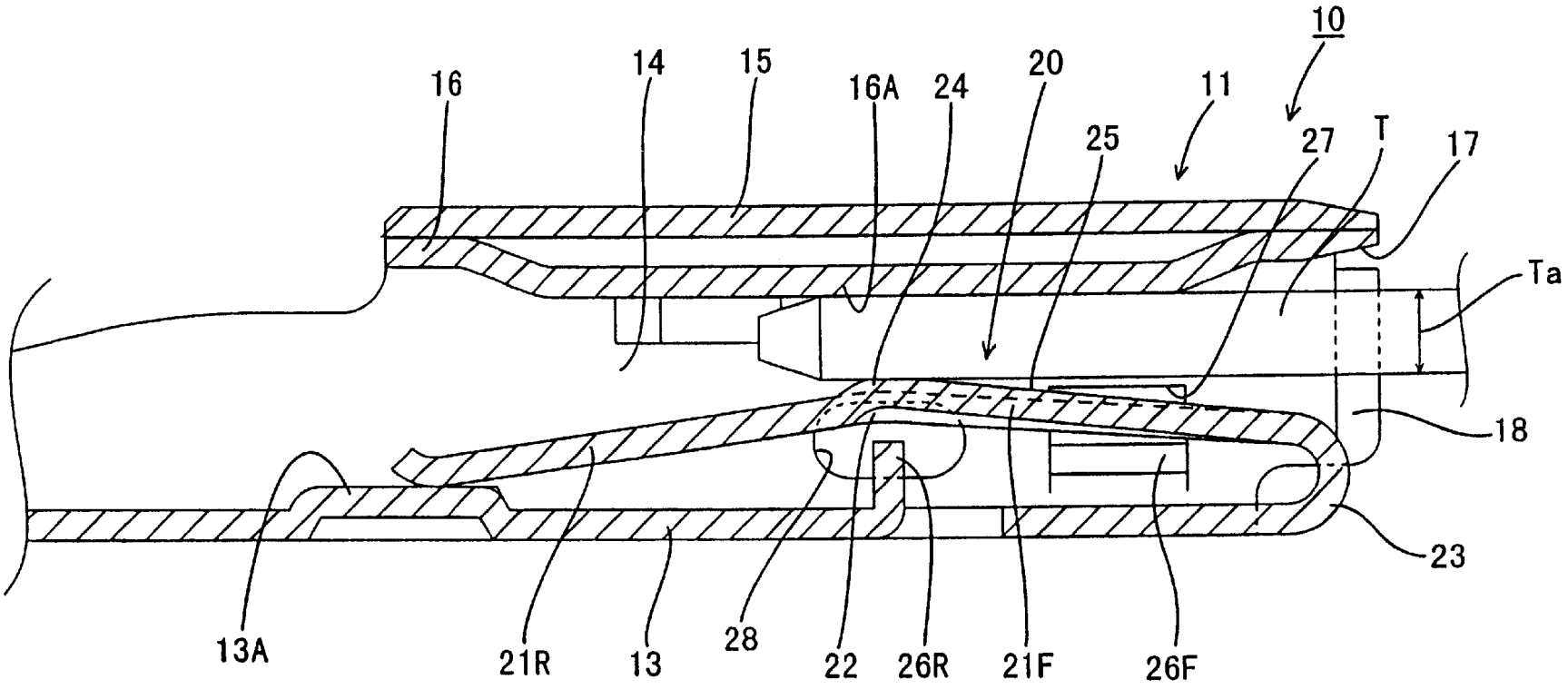
FIG. 5 is a cross-sectional view showing a tab inserted in a correct state.

In the following description FIG. 1 and FIGS. 4 to 7 are in an anterior-posterior direction, and the right side is considered to be the anterior. Hereafter, the up-down direction is with reference to FIGS. 1 to 3 and 5 to 7, and the left-right direction is with reference to FIGS. 2 and 3. Moreover, the insertion direction of a tab T relative to a female terminal fitting 10 refers to the anterior-posterior direction.

The female terminal fitting 10 of the present embodiment is formed by bending metal sheet which has been punched out in a specified shape. The entirety of the female terminal fitting 10 is long and narrow in the anterior-posterior direction. Approximately the anterior half thereof forms a fitting member 11, and a posterior half thereof forms an electric wire clamping member 12. The fitting member 11 has an angular tubular shape which is open to the anterior and posterior, and is formed from a base wall 13, a pair of side walls 14 rising upwards from left and right side edges of the base wall 13, and a pair of ceiling walls 15 and 16 which extend inwards from upper edges of the two side walls 14 and from a doubled-up upper and lower layer. The opening to the anterior side of the fitting member 11 is an insertion hole 17 for allowing the tab T of a male terminal fitting to be inserted. Anterior ends of the side walls 14 (left and right side edges of the insertion hole 17) are bent inwards, thereby forming a pair of movement regulating members 18. The space between these two movement regulating members 18 is slightly larger than the width of the tab T. Consequently, when the tab T is inserted into the fitting member 11, inner faces of the movement regulating members 18 face both side edges of the tab T, with a small space remaining therebetween (see FIG. 4).

A resilient contacting member 20 is housed within the fitting member 11, this resilient contacting member 20 being bent in a posterior direction from an anterior edge of the base wall 13. The resilient contacting member 20 has an angular shape when viewed from the side, an anterior portion thereof forming an inclined member 21F which is inclined downwards towards the anterior. An uppermost edge of this inclined member 21F is a contacting member 22. A portion to the posterior of the contacting member 22 is a posterior inclined member 21R. The resilient contacting member 20 can be bent by causing a bent-over member 23 at the anterior end thereof to bend. When the resilient contacting member 20 bends, the angle of inclination of the inclined members 21F and 21R relative to the base wall 13 decreases, a posterior end of the posterior inclined member 21R slides against a pedestal member 13A of the base wall 13, and the contacting member 22 becomes lower.

An embossed member 24 is formed by pressing in as upper face of the contacting member 22. This embossed member 24 rises upwards in a spherical shape and makes contact with a lower face of the tab T. Furthermore, an upper face of the embossed member 24 extends smoothly from the contacting member 22 to a location in the vicinity of an anterior edge of the anterior inclined face 21F, thereby forming a guiding protrusion 25. This guiding protrusion 25 is formed by pressing in, and gradually grows narrower in width from the posterior to the anterior. As the insertion of the tab T into the fitting member 11 commences, the tab T slides without catching over the guiding protrusion 25 until it reaches the embossed member 24. Further, a downwardly protruding pressing member 16A is formed by pressing in the lower ceiling wall 16. When the resilient contacting member 24 is in its natural, unbent, state, a space Sa is formed between the upper face of the embossed member 24 and a lower face of the pressing member 16A, this space Sa being slightly smaller, by a prescribed degree, than the thickness Ta of the tab T.

Two bending regulating members 26F and 26R are formed at differing locations within the fitting member 11, a space being provided therebetween in the anterior posterior direction. These bending regulating members 26F and 26R prevent the resilient contacting member 20 from bending excessively.

The anterior bending regulating members 26F are formed as a pair by cutting away portions of the left and right side walls 14 in a square shape and bending them inwards at approximately right angles at a location below the anterior inclined face 21F of the resilient contacting member 20. These anterior bending regulating members 26F are parallel with the direction of insertion of the tab T. Consequently, when the resilient contacting member 20 is in its natural state, the anterior inclined face 21F is in an inclined state relative to the anterior bending regulating members 26F. Upper faces of the anterior bending regulating members 26F are located at approximately the same height as an upper end of a bent inner side of the bent-over member 23 of the resilient contacting member 24. Consequently, when the resilient contacting member 24 has been bent resiliently, the anterior inclined face 21F is approximately parallel with the direction of insertion of the tab T and makes contact with the upper faces of the bending regulating members 26F. Moreover, cut-away holes 27 which open into the side walls 14 (these cut-away holes 27 are formed by cutting away the anterior bending regulating members 26F) allow the bent state (the degree of inclination) of the anterior inclined face 21F to be verified visually from the exterior of the fitting member 11.

The posterior bending regulating member 26R is formed from a wall differing from the ones from which the anterior bending regulating members 26F are formed. The posterior bending regulating member 26R is formed by cutting away a square portion of the base wall 13 and bending this portion upwards at approximately a right angle at a location directly below the contacting member 22 of the resilient contacting member 20. When the resilient contacting member 20 is in the free state, a space Sb, which is the space between an upper edge of the posterior bending regulating member 26R and a lower face of the contacting member 22, is larger than the difference in dimension between the space Sa (the space between the embossed member 24 and the pressing member 16A) and the thickness Ta of the tab T (this corresponds to the degree of up down movement of the contacting member 22 when the tab T has been inserted). Consequently, when the tab T has been correctly inserted and the resilient contacting member 20 has bent resiliently (see FIG. 5), a space is present between the tower face of the contacting member 22 and the upper edge of the posterior bending regulating member 26R.

The difference in dimension between the space Sa (the space between the embossed member 24 and the pressing member 16A) and an outer diameter Pa of a probe P for checking conductivity (this difference corresponds to the degree of up down movement of the contacting member 22 when the probe P has been inserted), is the same or smaller than the space Sb between the upper edge of the posterior bending regulating member 26R and the lower face of the contacting member 22. Consequently, when the probe P has been inserted and the resilient contacting member 20 has bent resiliently (see FIG. 7), the posterior bending regulating member 26R and the contacting member 22 make contact or an extremely small space remains between them.

The left and right side walls 14 of the fitting member 11 have window holes 28 for checking the space in an up-down direction between the contacting member 22 of the resilient contacting member 20 and the posterior bending regulating member 26R (that is, for checking the height of the bending regulating member 26R). These window holes 28 have a horizontal ellipsoid shape when viewed from the side. The window holes 28 are located such that the posterior bending regulating member 26R is located at the approximate centre thereof. The posterior bending regulating member 26R protrudes upwards from lower edges of the window holes 28, and the upper edge of the posterior bending regulating member 26R rises to an approximately central portion of the window holes 28. Furthermore, the window holes 28 and the resilient contacting member 20 are located relative to one another such that, when the resilient contacting member 20 is in the free state, the lower face of the contacting member 22 and upper edges of the window holes 28 are at approximately the same height.

Next, the operation of the present embodiment is explained.

After the female terminal fitting 10 has been formed, the height of the posterior bending regulating member 26R is checked to ensure that it is suitable. This check can be performed by placing the female terminal fitting 10 in a state whereby the interior of the fitting member 11 can be viewed via the window holes 28 of the side walls 14. There are three methods of checking. In the first method, one judges according to the manner in which the upper edge of the bending regulating member 26R is seen through the window holes 28. If the upper edge of the bending regulating member 26R cannot be seen through the window holes 28, this means that the bending regulating member 26R is too low and the resilient contacting member 20 may bend excessively. The article is accordingly judged defective. Conversely, if the upper edge of the bending regulating member 26R is higher than the opening of the window holes 28, with the bending regulating member 26R appearing to divide the window holes 28 into two actions, this means that the bending regulating member 26R is too high and it may impede the insertion of the tab T of the male terminal fitting or the insertion of the conductivity checking probe P. The article is accordingly judged defective. After the upper edge of the bending regulating member 26R is at a height whereby it fits suitably within the opening range of the window holes 28, the following check can be performed.

The second check is performed using the tab T. When the tab T is inserted into the fitting member 11, the contacting member 22 moves downwards as the resilient contacting member 20 bends resiliently, this allowing visual verification through the window holes 28. At this juncture, if the contacting member 22 does not make contact with the posterior bending regulating member 26R (see FIG. 5), the height of the bending regulating member 26R is suitable and does not impede contact with the tab T. Consequently, the article is judged non-defective. If the lower face of the contacting member 22 makes contact with the upper edge of the bending regulating member 26R when the tab T is inserted, the bending regulating member 26R is too high and may impede contact with the tab T. Consequently, the article is judged defective.

Furthermore in the case where the conductivity check of the female terminal fitting 10 is performed using the probe P, the probe P can be used to perform a third check on height. This check may take the place of the second check, or may be performed before or after it. When the probe P is inserted into the fitting member 11, the contacting member 22 moves downwards as the resilient contacting member 20 bends resiliently, this movement allowing visual verification through the window holes 28. At this juncture, if the lower face of the contacting member 22 makes approximate contact with the upper edge of the bending regulating member 26R (see FIG. 7), the height of the bending regulating member 26R is suitable and does not impede the conductivity check of the probe P. Consequently, the article is judged non-defective. Furthermore, in this state the resilient contacting member 20 remains within its range of bending. If the bending regulating member 26R is too high, the contacting member 22 makes contact with the upper edge of the bending regulating member 26R while the probe P is being inserted, preventing further bending of the resilient contacting member 20 and further insertion of the probe P. Consequently, the article is not suitable for the conductivity check and is judged defective.

Figure 6:
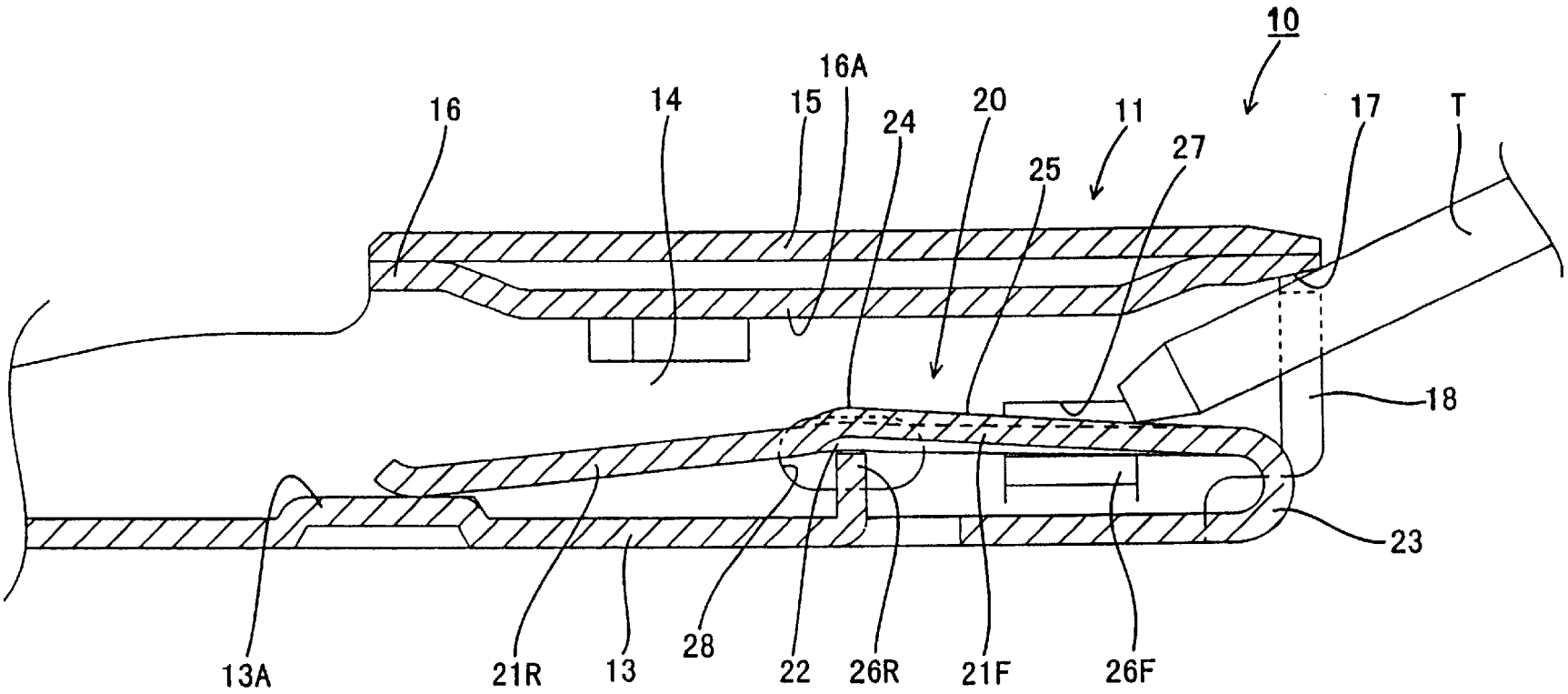
FIG. 6 in a cross-sectional view showing a tab inserted in an inclined state.
Figure 7:
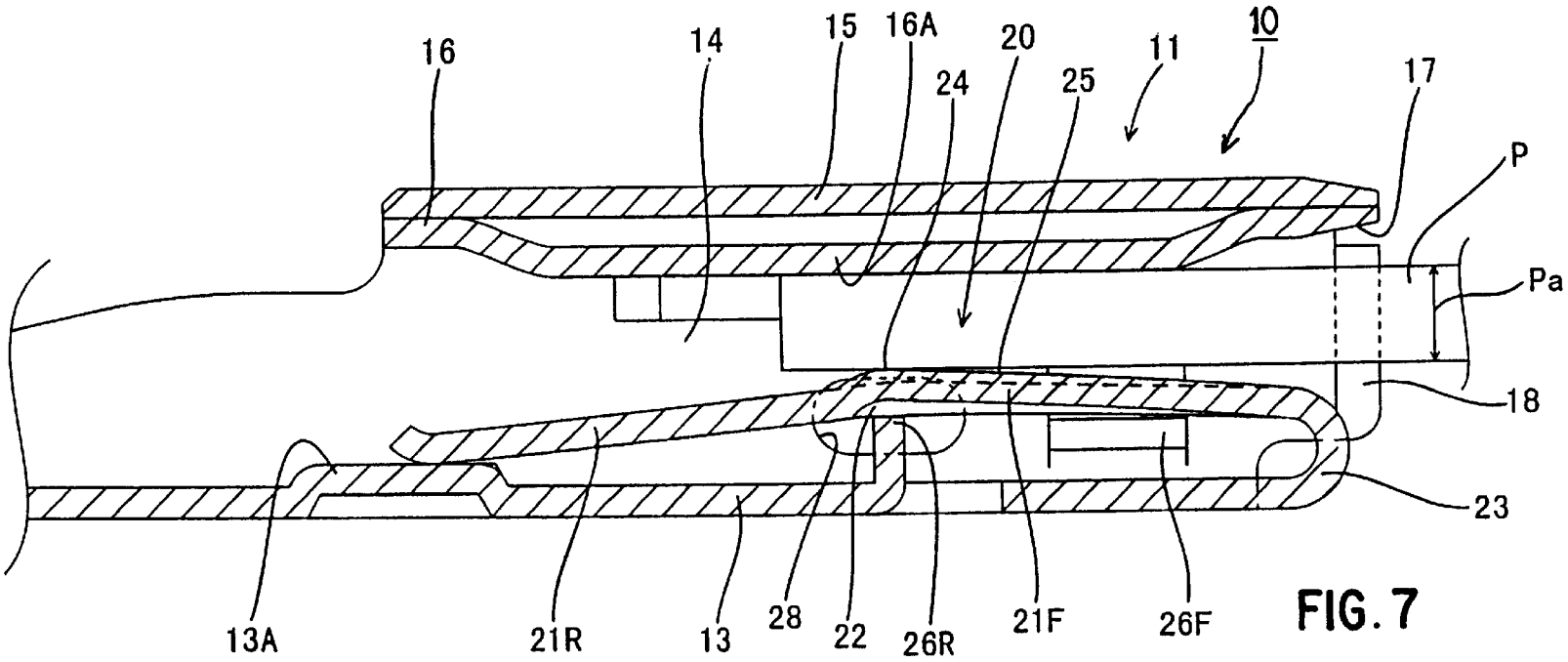
FIG. 7 is a cross-sectional showing a state whereby a probe has been inserted.
Figure 8:
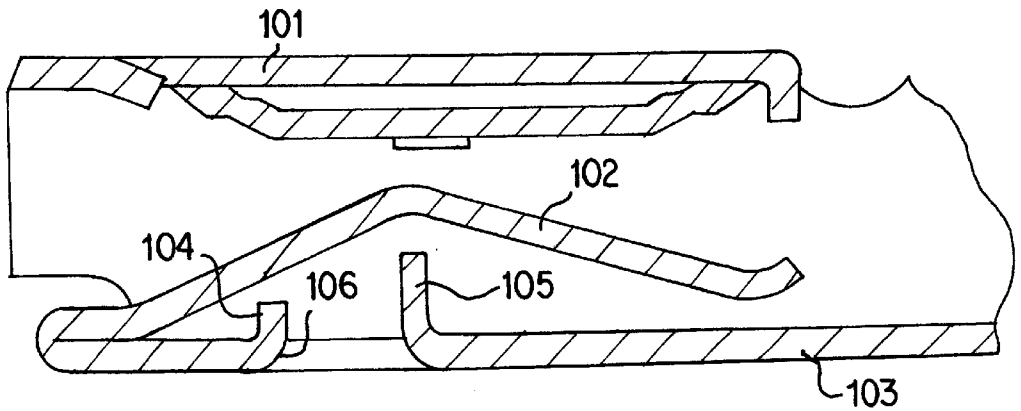
FIG. 8 PRIOR ART
FIG. 8 is a cross-sectional view of a prior art example.

As shown in FIG. 6, if the tab T is inserted into the fitting member 11 in a state whereby it is inclined downwards relative to its correct inserting direction, the tip of the tab T does not slide over the anterior inclined face 21F but strikes against it; this pushes the anterior inclined face 21F downwards and to the posterior. Then, within the range of resilient bending of the resilient contacting member 20, the anterior inclined face 21F makes contact with the upper faces of the anterior bending regulating members 26F and the contacting member 22 makes contact with the upper edge of the posterior bending regulating member 26R, thereby preventing further bending of the resilient contacting member 20. Consequently, the resilient contacting member 20 can reliably be prevented from exceeding its range of bending.

Furthermore, if the tab T is inserted in a state whereby it is inclined downwards, the tip of the tab T makes localized contact at a large angle with the anterior inclined face 21F. In a configuration where the tab T makes localized contact with the anterior inclined face 21F to the anterior or posterior of the bending regulating members, the position where the tab T makes contact is distant from the location which receives the bending regulating members. Consequently, there is the danger that the anterior inclined face 21F may change shape and become concave. However, in the present embodiment, the anterior inclined face 21F makes contact with the bending regulating members 26F along a wide range of this face along the anterior and posterior directions. As a result it is difficult for the contacting position of the tab T to be removed from the range which receives the bending regulating members 26F, and the anterior inclined face 21F is thereby prevented from changing shape. Moreover, the fact that the retaining face is wide means that the resisting force (rigidity) with respect to the contacting force of the tab T is large. Consequently, the anterior inclined face 21F is very reliably prevented from changing shape. Moreover, the entirety of the resilient contacting member 20 is also reliably prevented from being excessively bent.

In the present embodiment, the bending regulating members 26F and 26R are provided at two locations. An anterior location and a posterior location relative to the length-wise direction of the resilient contacting member 20. Consequently, the resilient contacting member 24 can reliably be prevented from bending excessively. Furthermore, the two bending regulating members 26F and 26R are formed on mutually differing walls (the side walls 14 and the base wall 13) of the fitting member 11. Consequently, compared to the case where the two bending regulating members 26F and 26R are formed an a single wall, the opening area formed by cutting away the bending regulating members is smaller an each wall, and consequently the walls are stronger.

After the female terminal fitting 10 has been funned, the tab T is inserted into the fitting member 11 and the space between the bending regulating member 26R and the contacting member 32 when the resilient contacting member 24 has bent resiliently is checked (that is, the height of the posterior bending regulating member 26R is checked). The window holes 28 are provided to allow this checking to be performed visually. This simplifies the checking operation. Moreover, the movement regulating members 18 are formed on the opening edge of the insertion hole 17 of the fitting member 11 by bending the anterior ends of the side walls 14 inwards. These movement regulating members 18 thereby oppose the side edges of the tab T. As a result, the interior dimension of the fitting member 11 relative to the width-wise direction of the tab T becomes smaller, and the clearance between the side walls 14), of the fitting member 11 and the side edges of the tab T is smaller. Consequently, the movement of the tab T in a width-wise direction is regulated. The present invention is not limited to the embodiments described above with the aid of figures. For example, the possibilities described below also lie within the technical range of the present invention. In addition, the present invention may be embodied in various other ways without deviating from the scope thereof.

(1) In the present embodiment, the anterior bending regulating members are formed on the side walls, and the posterior bending regulating member is formed an the base wall. However, according to the present invention, the anterior bending regulating members may be formed an the base wall, and the posterior bending regulating member may be formed on the side wall.

(2) In the present embodiment, the bending regulating members on the side walls are parallel to the direction of insertion of the tab. However, according to the present invention, the bending regulating members of the side walls may be inclined relative to the direction of insertion of the tab, or may be at right angles thereto (the up-down direction).

(3) In the present embodiment, the bending regulating member of the base wall is at a right-angle (the up-down direction) to the direction of insertion of the tab. However, according to the present invention, the bending regulating member of the base wall may be inclined relative to the direction of insertion of the tab.

(4) In the present embodiment, the posterior bending regulating member is provided in a location corresponding to the contacting member. However, according to the present invention, the anterior bending regulating members may be provided in a location corresponding to the contacting member of the resilient contacting member, and the posterior bending regulating member may be provided in a location corresponding to the posterior inclined member; the anterior and posterior bending regulating members may respectively be provided in locations corresponding to the anterior inclined member and the posterior inclined member; or the anterior and posterior bending regulating members may both be provided in locations corresponding to the anterior inclined member or to the posterior inclined member, (5) In the present embodiment, the anterior bending regulating members are parallel to the direction of insertion of the tab and the posterior bending regulating member is at a right angle to the direction of insertion of the tab. However, according to the present invention, the anterior bending regulating members may be at right angles to the direction of insertion of the tab and the posterior bending regulating member may be parallel to the direction of insertion of the tab.

(6) In the present embodiment, the movement regulating members are formed on the left and right side walls of the fitting member. However, according to the present invention, they may be provided on only the right side wall or the left side wall.

What is claimed is:

1. A female terminal fitting comprising an elongate box-like body of sheet metal having a generally uniform thickness, the body having an open end adapted to receive a male tab of a male terminal fitting in a fitting direction, the body further having a resilient contacting member extending in the fitting direction, the resilient contacting member being bent resiliently when in contact with the male tab, the female fitting further comprising bending regulating members part sheared from said body and underlying said contacting member to provide firm support and prevent excessive bending thereof, wherein said bending regulating members comprise proximal and distal bending regulating members formed from two or more adjacent walls of said body and disposed in juxtaposition in the fitting direction, wherein the proximal bending regulating member is part sheared from at least one sidewall and bent inward along a bend line that is generally parallel to the fitting direction, and wherein the proximal bending regulating member projects substantially orthogonally from the at least one sidewall of the body, the at least one sidewall being substantially perpendicular to the contacting member, to define a planar face that extends substantially in the fitting section a first distance and away from the sidewall from which the face projects a second distance, each distance being substantially greater than the thickness of the sheet metal for contact with a proximal portion of the contacting member, and wherein a distal portion of the distal bending regulating member projects and extends substantially orthogonally from a base wall of the body.

2. A fitting according to claim 1 wherein said open end has inturned wall portions on opposite sides, said wall portions defining therebetween a regulating space for a male tab.

3. A fitting according to claim 1 wherein a distal bending regulating member extends towards an underside of said contacting member, substantially at right angles thereto, and said body includes a window in a side wall thereof through which said distal bending regulating member is visible.

4. A fitting according to claim 3 wherein said window lies wholly to the underside of said contacting member when in the free condition.

5. A fitting according to claim 1 wherein said body has a base, two sides and a top, said contacting member being a cantilever extending from said base and having a free end angled towards said base in the fitting direction, said base having an indent providing a bearing surface for said free end in the free condition of said contacting member.

6. A fitting according to claim 5 wherein said top has a protrusion extending in the fitting direction and defining with said contacting member a contacting space for a male tab.

7. A fitting according to claim 1 wherein said resilient contacting member is a cantilever having a root connected to said body, and a contact for making electrical contact with a male tab, the proximal portion of the contacting member inclining in a free condition from said root to said contact with respect to said fitting direction.

8. A fitting according to claim 7 wherein said proximal bending regulating members are formed from opposite side walls of said body, each proximal bending regulating member having a planar face for contact with said proximal portion.

9. A fitting according to claim 7 wherein said proximal bending regulating member has an associated aperture in the wall of said body, said aperture being on an opposite side of said proximal bending regulating member to said contacting member.

10. A fitting according to claim 9 wherein proximal bending regulating members are formed from opposite side walls of said body each having a planar face for contact with said proximal portion.

11. A fitting according to claim 7 wherein said planar face extends in said fitting direction.

12. A fitting according to claim 11 wherein proximal bending regulating members are formed from opposite side walls of said body each having a planar face for contact with said proximal portion.

13. A fitting according to claim 11 wherein said proximal bending regulating member has an associated aperture in the wall of said body, said aperture being on an opposite side of said proximal bending regulating member to said contacting member.

14. A fitting according to claim 13 wherein proximal bending regulating members are fanned from opposite side walls of said body each having a planar face for contact with said proximal portion.

15. A female terminal fitting comprising an elongate box-like body of sheet metal and having an open end adapted to receive a male tab of a male terminal fitting in a fitting direction, the body having a resilient contacting member having a bent-over portion with an upper end at a certain height and a contact portion extending generally in the fitting direction, the resilient contacting member being bent resiliently when in contact with the male tab, the female fitting further comprising proximal and distal bending regulating members part sheared from said body and underlying said contacting member to provide firm support and prevent excessive beading thereof, wherein said bending regulating members are formed from two or more adjacent walls of said body, and wherein said bending regulating members each have a distal end portion that projects and extends substantially orthogonally from said walls and have a generally planar upper surface to contact the contacting member that is substantially at the height of the upper end of the bent-over portion of the contacting member such that the contacting member lies generally flat against the upper surfaces and is substantially parallel to the fitting direction when contacting the bending regulating members.

16. A female terminal fitting in accordance with claim 15 wherein the proximal bending regulating member is part sheared from at least one sidewall and bent inward along a bend line that is generally parallel to the fitting direction.

17. A female terminal fitting in accordance with claim 16 wherein the proximal bending regulating member projects substantially orthogonally from the at least one sidewall of the body, the at least one sidewall being substantially perpendicular to the contacting member, to define a planar face that extends substantially in the fitting direction a distance substantially greater than the thickness of the sheet metal as the upper surface for contacting the contacting member.

* * * * *